US007714517B2

(12) United States Patent
Shih et al.

(10) Patent No.: US 7,714,517 B2
(45) Date of Patent: May 11, 2010

(54) LED DRIVER WITH CURRENT SINK CONTROL AND APPLICATIONS OF THE SAME

(75) Inventors: Hung-Min Shih, Hsin-chu (TW); Tsung-Shiun Lee, Hsin-chu (TW); Chia-Hung Sun, Hsin-chu (TW); Huang-De Lin, Hsin-chu (TW)

(73) Assignee: AU Optronics Corporation, Hsinchu (TW)

( * ) Notice: Subject to any disclaimer, the term of this patent is extended or adjusted under 35 U.S.C. 154(b) by 468 days.

(21) Appl. No.: 11/737,343

(22) Filed: Apr. 19, 2007

(65) Prior Publication Data

US 2008/0258636 A1 Oct. 23, 2008

(51) Int. Cl.
*H05B 37/00* (2006.01)

(52) U.S. Cl. ..... 315/291; 315/307; 315/312

(58) Field of Classification Search ..... 315/307, 315/308, 291, 312, 246, 250
See application file for complete search history.

(56) References Cited

U.S. PATENT DOCUMENTS 4,104,533 A 8/1978 Iverson
6,490,512 B1 12/2002 Niggemann
6,621,235 B2 9/2003 Chang
6,864,867 B2 3/2005 Biebl
7,471,287 B2 * 12/2008 Chen et al. ..... 345/212
7,557,520 B2 * 7/2009 Chen et al. ..... 315/291

* cited by examiner

*Primary Examiner*—David Hung Vu
(74) *Attorney, Agent, or Firm*—Morris, Manning & Martin LLP; Tim Tingkang Xia

(57) ABSTRACT

A backlight system for use in an LCD display with a driver providing current sink control includes an LED array module, a current feedback circuit, and a current compensation circuit. The LED array module has N columns of LEDs and each LED column has M LEDs connected in serial, wherein the current feedback circuit includes N current feedback units and the current compensation circuit includes N current compensation units, both of the current feedback circuit and the current compensation circuit being electrically coupled to the LED array module. When the backlight system is in operation, a current passes through an LED column, a current feedback unit, and a current compensation unit to generate an output voltage that is used for comparison with a predetermined DC voltage, and the current is compensated based on the results of the comparison.

25 Claims, 8 Drawing Sheets

(B)

(A)

LED DRIVER WITH CURRENT SINK CONTROL AND APPLICATIONS OF THE SAME

FIELD OF THE INVENTION

The present invention relates generally to a light emitting diode driver, and more particularly, to a light emitting diode driver with current sink control for a liquid crystal display.

BACKGROUND OF THE INVENTION

A liquid crystal display (hereinafter "LCD") usually requires a cold cathode fluorescent lamp to provide backlight to display an image on an LCD screen. In recent years, light emitting diode (hereinafter "LED") array modules have emerged as a new backlight source and it becomes increasingly popular because it provides more vivid and brighter color images.

An LED array module is generally configured as an I×J LEDs array, where I=1, 2, . . . N, J=1, 2, . . . M, and N and M are positive integers. An LED array module includes N columns of LED, where each LED column has M individual LEDs. Usually, each LED in an LED column is electrically coupled in serial. The anode of the first LED forms a first terminal of the LED column, and the cathode of the first LED is electrically coupled to the anode of the second LED. The cathode of the second LED is electrically coupled to the anode of the third LED, and so on. The anode of the last LED in the column is electrically coupled to the cathode of the one next to the last LED, and the cathode of the last LED forms a second terminal of the LED column. Each LED column is usually powered by a direct current (hereinafter "DC") voltage and a current driver such that a constant current is provided to the LED column for a consistent and even backlight. Other LED columns are usually connected in parallel and each LED column has its own DC power supply. Ideally, when a constant DC voltage is applied to each identical LED column, the current through each LED column should be identical, yielding an even and consistent backlight.

Due to the manufacturing variation, however, each LED may exhibits different resistance/impedance. These deviations cause these LED columns each to have different current passing through when a constant DC voltage is applied to the LED column. In order to provide an even, consistent backlight, the same and constant DC current is required for each and every LED column. An individual current driver circuit is supplied to each LED column to provide a constant current through these LED columns.

FIG. 7 shows an integrated LED driving device for multiple LED strings disclosed by Chang et al. in U.S. Pat. No. 6,621,235, which is incorporated herein in its entirety by reference for background information only. The LED driving device employs a single linear regulator or other controller and a multiple-output current mirror that is almost independent of the DC input voltage source, almost independent of the transistor's or MOSFET's variations from the semiconductor integration process, and almost independent of temperature variation. This LED driving device controls each LED cluster by using the current mirror and adjust the current through the LED cluster. It uses high frequency switching technique to achieve current balance and color temperature compensation. However, such a driving device consumes a large sum of electrical energy and produces large amounts of heat during operation. Additionally, this LED driving device can only be used for a single color LED backlight.

FIG. 8 shows a driving circuit for an LED array was disclosed by Alois Biebl in U.S. Pat. No. 6,864,867, which is also incorporated herein in its entirety by reference for background information only. This driving circuit has a first LED cluster and at least one second LED cluster. A control loop is designed to drive a switch of the first LED cluster so as to achieve a constant mean value of the current flowing through the first LED cluster. The control loop is designed for driving switches of the further LED clusters. This circuit uses a controller, similar to the controller described in U.S. Pat. No. 6,621,235, which is also incorporated herein in its entirety by reference for background information only, to achieve the current balance in the LED clusters. The range of controllable current through the LED clusters is limited. Such a driving device also consumes a large sum of electrical energy and produces large amounts of heat during operation.

Therefore, a heretofore unaddressed need exists in the art to address the aforementioned deficiencies and inadequacies.

SUMMARY OF THE INVENTION

The present invention, in one aspect, relates to a current feedback circuit for use in an LED driver with current sink control. In one embodiment, the current feedback circuit has N current feedback units, where N is a positive integer. Each of N current feedback units includes: (i) an input, (ii) a first output, (iii) a second output, (iv) a first reference line for receiving a first supply voltage, (v) a second reference line for receiving a second supply voltage, (vi) a ground terminal for connecting to the ground of the LED driver, (vii) an operational amplifier (op-amp), (viii) a first resistor, (ix) a second resistor, (x) a third resistor, (xi) a fourth resistor, and (xii) a fifth resistor. Each of the resistors has a first terminal and a second terminal.

The op-amp has a positive input, a negative input, an output, a first power supply input, and a second power supply input. The first power supply input is electrically coupled to the first reference line. The second power supply input is electrically coupled to the second reference line. The output is electrically coupled to the second output.

The first terminal of the first resistor is electrically coupled to the input, and the second terminal of the first resistor is electrically coupled to the first output. The first terminal of the second resistor is electrically coupled to the first terminal of the first resistor, and the second terminal of the second resistor is electrically coupled to the positive input of the op-amp. The first terminal of the third resistor is electrically coupled to the second terminal of the first resistor, and the second terminal of the third resistor is electrically coupled to the negative input of the op-amp. The first terminal of the fourth resistor is electrically coupled to the negative input of the op-amp, and the second terminal of the fourth resistor is electrically coupled to the output of the op-amp and the second output. The first terminal of the fifth resistor is electrically coupled to the positive input of the op-amp, and the second terminal of the fifth resistor is electrically coupled to the ground terminal.

Each of the current feedback unit is adapted for coupling with a column of LED that has a plurality of LEDs connected in serial, {Dj}, j=1, 2, . . . , M, M being a positive integer. Each of the plurality of LEDs has an anode and a cathode. The LED column has a first terminal and a second terminal. The first terminal of the LED column is electrically coupled to the anode of the first LED $D_1$. The anode of the j-th LED $D_j$ is electrically coupled to the cathode of the (j−1)-th LED $D_{j-1}$. The cathode of the j-th LED $D_j$ is electrically coupled to the anode of the (j+1)-th LED $D_{j+1}$. The cathode of the M-th LED $D_M$ is electrically coupled to the second terminal of the LED column, respectively.

In another aspect, the present invention relates to a current compensation circuit for use in an LED driver with current sink control. In one embodiment, the current compensation circuit has N current compensation units. Each of the N current compensation units includes: (i) a first input, (ii) a second input, (iii) a third input, (iv) a first reference line for receiving a first supply voltage, (v) a second reference line for receiving a second supply voltage, (vi) a ground terminal for connecting to the ground of the LED driver, (vii) a comparator, (viii) a sixth resistor, (ix) a seventh resistor, and (x) an eighth resistor. Each of the resistors has a first terminal and a second terminal.

The comparator has a positive input, a negative input, an output, a first power supply input, and a second power supply input. The first power supply input is electrically coupled to the first reference line. The second power supply input is electrically coupled to the second reference line. The positive input is electrically coupled to the second input. The negative input is electrically coupled to the third input;

The first terminal of the sixth resistor is electrically coupled to the first input, and the second terminal of the sixth resistor is electrically coupled to the ground terminal. The first terminal of the seventh resistor is electrically coupled to the first input and the first terminal of the sixth resistor, and the second terminal of the seventh resistor is electrically coupled to the output of the comparator. The first terminal of the eighth resistor is electrically coupled to the first reference line and the first power supply input of the comparator, the second terminal of the eighth resistor is electrically coupled to the output of the comparator and the second terminal of the seventh resistor.

Each of the N current compensation units is adapted for coupling with a column of LED that has a plurality of LEDs connected in serial, {Dj}, j=1, 2, . . . , M, M being a positive integer. Each of the plurality of LEDs of the column of LED has an anode and a cathode. The LED column has a first terminal and a second terminal. The first terminal of the LED column is electrically coupled to the anode of the first LED $D_1$. The anode of the j-th LED $D_j$ is electrically coupled to the cathode of the (j−1)-th LED $D_{j-1}$. The cathode of the j-th LED $D_j$ is electrically coupled to the anode of the (j+1)-th LED $D_{j-1}$. The cathode of the M-th LED $D_M$ is electrically coupled to the second terminal of the LED column, respectively.

In a further aspect, the present invention relates to a backlight system for use in an LCD display with a driver providing current sink control. In one embodiment, the backlight system has (i) an LED array module, (ii) a current feedback circuit, and (iii) a current compensation circuit.

The LED array module has N columns of LEDs, {Ci}, i=1, 2, . . . , N, N being a positive integer. Each LED column has a first terminal, a second terminal and a plurality of LEDs connected in serial, $\{R_j\}$, j=1, 2, . . . , M, M being a positive integer. Each of the plurality of LEDs of an LED column has an anode and a cathode. The anode of the first LED of an LED column is electrically coupled to the first terminal of the LED column. The cathode of the j-th LED $R_j$ is electrically coupled to the anode of the (j+1)-th LED $R_{j+1}$. The anode of the j-th LED $R_j$ is electrically coupled to the cathode of the (j−1)-th LED $R_{j-1}$. The cathode of the M-th LED $R_M$ of the LED column is electrically coupled to the second terminal of the LED column. The N LED columns are electrically coupled in parallel. Each of the first terminal of the N LED columns is electrically coupled to a DC power supply.

The current feedback circuit includes N current feedback units {CFn}, n=1, 2, . . . , N. Each of the N current feedback units has an input, a first output and a second output. The n-th current feedback unit CFn is electrically coupled to the n-th LED column Cn. The first input of the n-th current feedback unit is electrically coupled to the second terminal of the n-th LED column Cn.

The current compensation circuit includes N current compensation units {CCn}, n=1, 2, . . . , N. Each of the N current compensation units has a first input, and a second input, and a third input. The n-th current compensation unit CCn is electrically coupled to the n-th current feedback unit CFn. The first output of the n-th current feedback unit CFn is electrically coupled to the first input of the n-th current compensation unit CCn, and the second output of the n-th current feedback unit CFn is electrically coupled to the second input of the n-th current compensation unit CCn, respectively.

When the backlight system is in operation, a current passes through the n-th LED column, the first input and first output of the n-th current feedback unit CFn, and the first input of the n-th current compensation unit CCn. An output voltage is generated at the second output of the n-th current feedback unit CFn. The output voltage is provided to the second input of the n-th current compensation unit for comparison with a predetermined DC voltage electrically coupled to the third input of the current compensation unit CCn. The n-th current compensation unit CCn compensates for the current based on the results of the comparison.

Each of the N current feedback units includes: (i) a first reference line for receiving a first supply voltage, (ii) a second reference line for receiving a second supply voltage, (iii) a ground terminal for connecting to the ground of the LED driver, (iv) an operational amplifier (op-amp), (v) a first resistor, (vi) a second resistor, (vii) a third resistor, (viii) a fourth resistor, and (ix) a fifth resistor. Each of the resistors has a first terminal and a second terminal.

The op-amp has a positive input, a negative input, an output, a first power supply input, and a second power supply input. The first power supply input is electrically coupled to the first reference line. The second power supply input is electrically coupled to the second reference line. The output is electrically coupled to the second output.

The first terminal of the first resistor is electrically coupled to the first input, and the second terminal of the first resistor is electrically coupled to the first output. The first terminal of the second resistor is electrically coupled to the first terminal of the first resistor, and the second terminal of the second resistor is electrically coupled to the positive input of the op-amp. The first terminal of the third resistor is electrically coupled to the second terminal of the first resistor, and the second terminal of the third resistor is electrically coupled to the negative input of the op-amp. The first terminal of the fourth resistor is electrically coupled to the negative input of the op-amp, and the second terminal of the fourth resistor is electrically coupled to the output of the op-amp and the second output. The first terminal of the fifth resistor is electrically coupled to the positive input of the op-amp, and the second terminal of the fifth resistor is electrically coupled to the ground terminal.

Each of the N current compensation units includes: (i) a first input, (ii) a second input, (iii) a third input, (iv) a first reference line for receiving a first supply voltage, (v) a second reference line for receiving a second supply voltage, (vi) a ground terminal for connecting to the ground of the LED driver, (vii) a comparator, (viii) a sixth resistor, (ix) a seventh resistor, and (x) an eighth resistor. Each of the resistors has a first terminal and a second terminal.

The comparator has a positive input, a negative input, an output, a first power supply input, and a second power supply input. The first power supply input is electrically coupled to the first reference line. The second power supply input is electrically coupled to the second reference line. The positive input is electrically coupled to the second input. The negative input is electrically coupled to the third input.

The first terminal of the sixth resistor is electrically coupled to the first input, and the second terminal of the sixth resistor is electrically coupled to the ground terminal. The first terminal of the seventh resistor is electrically coupled to the first input and the first terminal of the sixth resistor, and the second terminal of the seventh resistor is electrically coupled to the output of the comparator. The first terminal of the eighth resistor is electrically coupled to the first reference line and the first power supply input of the comparator, the second terminal of the eighth resistor is electrically coupled to the output of the comparator and the second terminal of the seventh resistor.

When the output voltage of the n-th current feedback unit CFn is greater than the predetermined DC voltage electrically coupled to the third input of the n-th current compensation unit CCn, the output of the comparator of the n-th current compensation unit CCn provides a positive voltage to cause a compensation current to flow from the second terminal to the first terminal of the seventh resistor. When the output voltage of the n-th current feedback unit CFn is less than the predetermined DC voltage electrically coupled to the third input of the n-th current compensation unit CCn, the output of the comparator of the n-th current compensation unit CCn provides a negative voltage to cause a compensation current to flow from the first terminal to the second terminal of the seventh resistor.

The LED array module provides backlights with a plurality of colors for the LCD panel. A plurality smaller sized LED array modules can be combined to provide backlight for LCD panels of larger sizes. The current of each of the N LED columns is individually controllable and precisely compensatable.

A column of M LEDs in a first color L1*i*, a column of M LEDs in a second color L2*i*, and a column of M LEDs in a third color L3*i*, {i}, i=1, 2, . . . , M, are combined to provide multi-color backlight for a LCD panel. The i-th LED L1*i* in first color, the i-th LED L2*i* in second color and the i-th LED L3*i* in third color are combined to provide backlight for a corresponding portion of the LCD panel.

In yet another aspect, the present invention relates to an LED driver with current sink control for an LCD array module. In one embodiment, the backlight system has (i) a current feedback circuit, and (ii) a current compensation circuit.

The LED array module has N columns of LEDs, {Ci}, i=1, 2, . . . , N, N being a positive integer. Each of the N LED column has a first terminal, a second terminal and a plurality of light emitting diodes connected in serial, {Rj}, j=1, 2, . . . , M, M being a positive integer. Each of the LEDs has an anode and a cathode. The anode of the first LED $R_1$ of an LED column is electrically coupled to the first terminal of the LED column. The cathode of the j-th LED $R_j$ is electrically coupled to the anode of the (j+1)-th LED. The anode of the j-th LED $R_j$ is electrically coupled to the cathode of the (j−1)-th LED $R_{j+1}$. The cathode of the last LED $R_M$ of the LED column is electrically coupled to the second terminal of the LED column. The N LED columns are electrically coupled in parallel and each first terminal of each of the N LED columns is electrically coupled to a DC power supply.

The current feedback circuit has N current feedback units {CFn}, n=1, 2, . . . , N. Each of the N current feedback units has an input, a first output and a second output. The n-th current feedback unit CFn is electrically coupled to the n-th LED column Cn. The first input of the n-th current feedback unit is electrically coupled to the second terminal of the n-th LED column Cn.

The current compensation circuit has N current compensation units {CCn}, n=1, 2, . . . , N. Each of the N current compensation units has a first input, and a second input, and a third input. The n-th current compensation unit CCn is electrically coupled to the n-th current feedback unit CFn. The first output of the n-th current feedback unit CFn is electrically coupled to the first input of the n-th current compensation unit CCn, and the second output of the n-th current feedback unit CFn is electrically coupled to the second input of the n-th current compensation unit CCn, respectively.

When the LED driver with current sink control is in operation, a current passes through the n-th LED column, the first input and first output of the n-th current feedback unit CFn, and the first input of the n-th current compensation unit CCn. An output voltage is generated at the second output of the n-th current feedback unit CFn. The output voltage is provided to the second input of the n-th current compensation unit CCn for comparison with a predetermined DC voltage electrically coupled to the third input of the n-th current compensation unit CCn, and the n-th current compensation unit CCn compensates the current based on the results of the comparison.

Each of the N current feedback units includes: (i) a first reference line for receiving a first supply voltage, (ii) a second reference line for receiving a second supply voltage, (iii) a ground terminal for connecting to the ground of the LED driver, (iv) an operational amplifier (op-amp), (v) a first resistor, (vi) a second resistor, (vii) a third resistor, (viii) a fourth resistor, and (ix) a fifth resistor. Each of the resistors has a first terminal and a second terminal.

The op-amp has a positive input, a negative input, an output, a first power supply input, and a second power supply input. The first power supply input is electrically coupled to the first reference line. The second power supply input is electrically coupled to the second reference line. The output is electrically coupled to the second output.

The first terminal of the first resistor is electrically coupled to the first input, and the second terminal of the first resistor is electrically coupled to the first output. The first terminal of the second resistor is electrically coupled to the first terminal of the first resistor, and the second terminal of the second resistor is electrically coupled to the positive input of the op-amp. The first terminal of the third resistor is electrically coupled to the second terminal of the first resistor, and the second terminal of the third resistor is electrically coupled to the negative input of the op-amp. The first terminal of the fourth resistor is electrically coupled to the negative input of the op-amp, and the second terminal of the fourth resistor is electrically coupled to the output of the op-amp and the second output. The first terminal of the fifth resistor is electrically coupled to the positive input of the op-amp, and the second terminal of the fifth resistor is electrically coupled to the ground terminal.

Each of the N current compensation units includes: (i) a first input, (ii) a second input, (iii) a third input, (iv) a first reference line for receiving a first supply voltage, (v) a second reference line for receiving a second supply voltage, (vi) a ground terminal for connecting to the ground of the LED driver, (vii) a comparator, (viii) a sixth resistor, (ix) a seventh resistor, and (x) an eighth resistor. Each of the resistors has a first terminal and a second terminal.

The comparator has a positive input, a negative input, an output, a first power supply input, and a second power supply input. The first power supply input is electrically coupled to the first reference line. The second power supply input is electrically coupled to the second reference line. The positive input is electrically coupled to the second input. The negative input is electrically coupled to the third input;

The first terminal of the sixth resistor is electrically coupled to the first input, and the second terminal of the sixth resistor is electrically coupled to the ground terminal. The first terminal of the seventh resistor is electrically coupled to the first input and the first terminal of the sixth resistor, and the second terminal of the seventh resistor is electrically coupled to the output of the comparator. The first terminal of the eighth resistor is electrically coupled to the first reference line and the first power supply input of the comparator, the second terminal of the eighth resistor is electrically coupled to the output of the comparator and the second terminal of the seventh resistor.

When the output voltage of the n-th current feedback unit CFn is greater than the predetermined DC voltage electrically coupled to the third input of the n-th current compensation unit CCn, the output of the comparator of the n-th current compensation unit CCn provides a positive voltage to cause a compensation current to flow from the second terminal to the first terminal of the seventh resistor. When the output voltage of the n-th current feedback unit CFn is less than the predetermined DC voltage electrically coupled to the third input of the n-th current compensation unit CCn, the output of the comparator of the n-th current compensation unit CCn provides a negative voltage to cause a compensation current to flow from the first terminal to the second terminal of the seventh resistor.

In a further aspect, the present invention relates to a backlight system for use in an LCD display with a driver providing current sink control. In one embodiment, the backlight system has (i) an LED array module, (ii) a current feedback circuit, and (iii) a current compensation circuit.

The LED array module has N columns of LEDs, {Ci}, i=1, 2, . . . , N, N being a positive integer. Each LED column has a first terminal, a second terminal and a plurality of LEDs connected in serial, {Rj}, j=1, 2, . . . , M, M being a positive integer. Each of the plurality of LEDs has an anode and a cathode. The anode of the first LED $R_1$ of the LED column is electrically coupled to the first terminal of the LED column. The cathode of the j-th LED $R_j$ is electrically coupled to the anode of the (j+1)-th LED $R_{j+1}$. The anode of the j-th LED $R_j$ is electrically coupled to the cathode of the (j−1)-th LED $R_{j-1}$. The cathode of the last LED $R_M$ of the LED column is electrically coupled to the second terminal of the LED column. The N LED columns are electrically coupled in parallel.

The current feedback circuit has N current feedback units {CFn}, n=1, 2, . . . , N. Each of the N current feedback units CFn has an input, a first output and a second output. The input of the n-th current feedback unit CFn is electrically coupled to the n-th LED column Cn and a DC power supply. The first input of the n-th current feedback unit is electrically coupled to the DC power supply, and the first output of the n-th current feedback unit is electrically coupled to the first terminal of the n-th LED column Cn.

The current compensation circuit has N current compensation units {CCn}, n=1, 2, . . . , N. Each of the N current compensation units has a first input, a second input, and a third input. The n-th current compensation unit CCn is electrically coupled to the n-th current feedback unit CFn and the n-th LED column. The second terminal of the n-th LED column is electrically coupled to the first input of the n-th current compensation unit CCn. The second input of the n-th current compensation unit CCn is electrically coupled to the second output of the n-th current feedback unit CFn.

When the backlight system is in operation, a current passes through the first input and first output of the n-th current feedback unit CFn, the n-th LED column, and the first input of the n-th current compensation unit CCn. An output voltage is generated at the second output of the n-th current feedback unit CFn. The output voltage is provided to the second input of the n-th current compensation unit CCn for comparison with a predetermined DC voltage electrically coupled to the third input of the current compensation unit CCn. The n-th current compensation unit CCn compensates the current based on the results of the comparison.

Each of the N current feedback units includes: (i) a first reference line for receiving a first supply voltage, (ii) a second reference line for receiving a second supply voltage, (iii) a ground terminal for connecting to the ground of the LED driver, (iv) an operational amplifier (op-amp), (v) a first resistor, (vi) a second resistor, (vii) a third resistor, (viii) a fourth resistor, and (ix) a fifth resistor. Each of the resistors has a first terminal and a second terminal.

The op-amp has a positive input, a negative input, an output, a first power supply input, and a second power supply input. The first power supply input is electrically coupled to the first reference line. The second power supply input is electrically coupled to the second reference line. The output is electrically coupled to the second output.

The first terminal of the first resistor is electrically coupled to the first input, and the second terminal of the first resistor is electrically coupled to the first output. The first terminal of the second resistor is electrically coupled to the first terminal of the first resistor, and the second terminal of the second resistor is electrically coupled to the positive input of the op-amp. The first terminal of the third resistor is electrically coupled to the second terminal of the first resistor, and the second terminal of the third resistor is electrically coupled to the negative input of the op-amp. The first terminal of the fourth resistor is electrically coupled to the negative input of the op-amp, and the second terminal of the fourth resistor is electrically coupled to the output of the op-amp and the second output. The first terminal of the fifth resistor is electrically coupled to the positive input of the op-amp, and the second terminal of the fifth resistor is electrically coupled to the ground terminal.

Each of the N current compensation units includes: (i) a first input, (ii) a second input, (iii) a third input, (iv) a first reference line for receiving a first supply voltage, (v) a second reference line for receiving a second supply voltage, (vi) a ground terminal for connecting to the ground of the LED driver, (vii) a comparator, (viii) a sixth resistor, (ix) a seventh resistor, and (x) an eighth resistor. Each of the resistors has a first terminal and a second terminal.

The comparator has a positive input, a negative input, an output, a first power supply input, and a second power supply input. The first power supply input is electrically coupled to the first reference line. The second power supply input is electrically coupled to the second reference line. The positive input is electrically coupled to the second input. The negative input is electrically coupled to the third input;

The first terminal of the sixth resistor is electrically coupled to the first input, and the second terminal of the sixth resistor is electrically coupled to the ground terminal. The first terminal of the seventh resistor is electrically coupled to the first input and the first terminal of the sixth resistor, and the second terminal of the seventh resistor is electrically coupled to the output of the comparator. The first terminal of the eighth resistor is electrically coupled to the first reference line and the first power supply input of the comparator, the second terminal of the eighth resistor is electrically coupled to the output of the comparator and the second terminal of the seventh resistor.

When the output voltage of the n-th current feedback unit CFn is greater than the predetermined DC voltage electrically coupled to the third input of the n-th current compensation unit CCn, the output of the comparator of the n-th current compensation unit CCn provides a positive voltage to cause a compensation current to flow from the second terminal to the first terminal of the seventh resistor. When the output voltage of the n-th current feedback unit CFn is less than the predetermined DC voltage electrically coupled to the third input of the n-th current compensation unit CCn, the output of the comparator of the n-th current compensation unit CCn provides a negative voltage to cause a compensation current to flow from the first terminal to the second terminal of the seventh resistor.

The current of each of the N LED columns of the backlight system is individually controllable and precisely compensatable.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
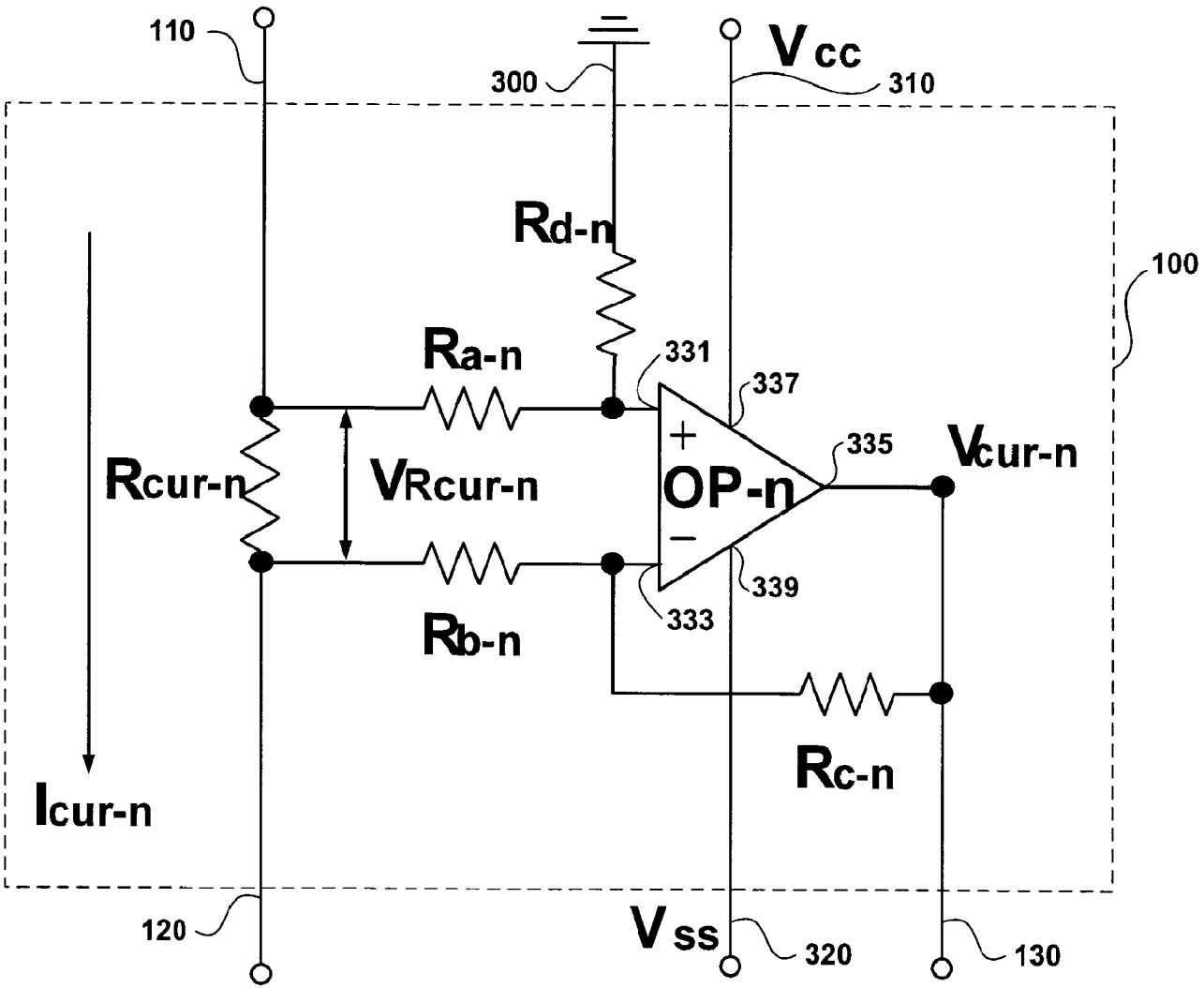
FIG. 1 partially shows a circuit diagram of a current feedback unit for an LED driver with current sink control according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1-8. In accordance with the purposes of this invention, as embodied and broadly described herein, this invention, in one aspect, relates to an LED driver with current sink control.

Referring now to FIG. 1, a circuit diagram of a current feedback unit for an LED driver with current sink control is partially shown according to one embodiment of the present invention. In the embodiment, the current feedback circuit for use in an LED driver with current sink control has a plurality of current feedback units {n}, n=1, 2, . . . N, where N is a positive integer. The n-th current feedback unit 100, a representative current feedback unit of the plurality of current feedback units has an input 110, a first output 120, a second output 130, a first reference line 310 for receiving a first supply voltage, a second reference line 320 for receiving a second supply voltage, a ground terminal 300 for coupling to the ground of the LED driver, an operational amplifier OP-n, a first resistor $R_{cur-n}$, a second resistor $R_{a-n}$, a third resistor $R_{b-n}$, a fourth resistor $R_{c-n}$, and a fifth resistor $R_{d-n}$. Each of the first resistor $R_{cur-n}$, the second resistor $R_{a-n}$, the third resistor $R_{b-n}$, the fourth resistor $R_{c-n}$ and the fifth resistor $R_{d-n}$ has a first terminal and a second terminal, respectively.

The operational amplifier OP-n has a positive input 331, a negative input 333, an output 335, a first power supply input 337, and a second power supply input 339. The first power supply input 337 is coupled to the first reference line 310. The second power supply input 339 is coupled to the second reference line 320. The output 335 is coupled to the second output 130. The first terminal of the first resistor $R_{cur-n}$ is coupled to the first input 110. The second terminal of the first resistor $R_{cur-n}$ is coupled to the first output 120. The first terminal of the second resistor $R_{a-n}$ is coupled to the first terminal of the first resistor $R_{cur-n}$. The second terminal of the second resistor $R_{a-n}$ is coupled to the positive input 331 of the operational amplifier OP-n. The first terminal of the third resistor $R_{b-n}$ is coupled to the second terminal of the first resistor $R_{cur-n}$ and the second terminal of the third resistor $R_{b-n}$ is coupled to the negative input of the operational amplifier OP-n. The first terminal of the fourth resistor $R_{c-n}$ is coupled to the negative input 333 of the operational amplifier OP-n. The second terminal of the fourth resistor $R_{c-n}$ is coupled to the output 335 of the operational amplifier OP-n and the second output 130. The first terminal of the fifth resistor $R_{d-n}$ is coupled to the positive input 331 of the operational amplifier OP-n. The second terminal of the fifth resistor $R_{d-n}$ is coupled to the ground terminal 300.

For the n-th current feedback unit 100, the current flowing from the first input 110 to the first output 120 and the first resistor $R_{cur-n}$ is designated as $I_{cur-n}$. The current $I_{cur-n}$ generates a voltage $V_{Rcur-n}$ across the first resistor $R_{cur-n}$. The voltage $V_{Rcur-n}$ is multiplied through operational amplifier OP-n and the resistors $R_{a-n}$, $R_{b-n}$, $R_{c-n}$, and $R_{d-n}$. The output $V_{cur-i}$ of the operational amplifier OP-n is calculated as $$V_{cur-n}=(R_{c-n})\times(V_{Rcur-n})/(R_{a-n}) \quad (1)$$

where $R_{a-n}=R_{b-n}$, and $R_{c-n}=R_{d-n}$. The voltage $V_{cur-n}$ is used for the closed circuit control and compensation for the current through n-th LED column.

Figure 2:
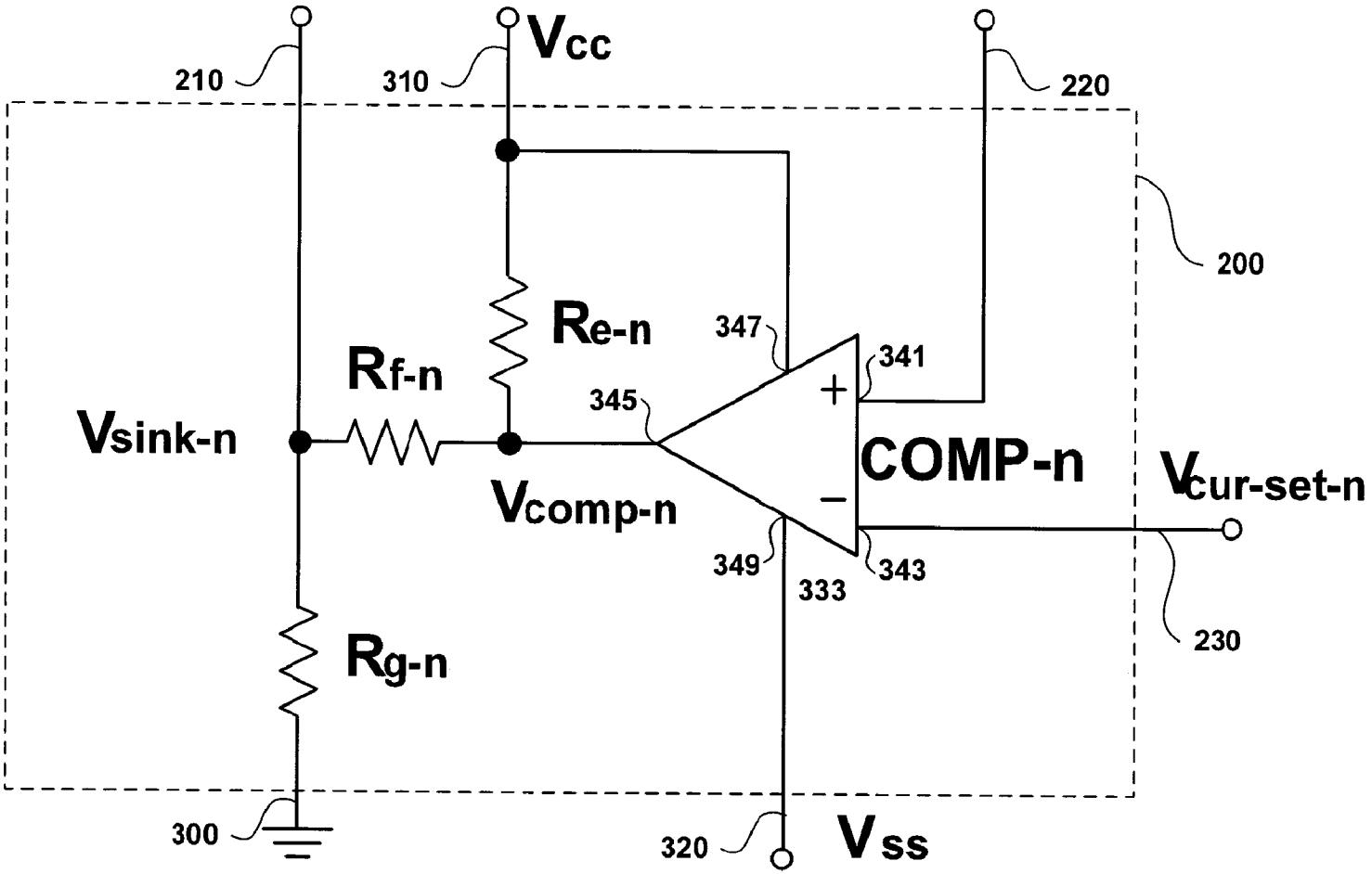
FIG. 2 partially shows a circuit diagram of a current compensation unit for an LED driver with current sink control according to one embodiment of the present invention.

Referring now to FIG. 2, a circuit diagram of a current compensation unit for an LED driver with current sink control is shown according to one embodiment of the present invention. In the embodiment, the current compensation circuit for using in an LED driver with current sink control has a plurality of current feedback units {n}, n=1, 2, . . . N, where N is a positive integer. The n-th current compensation unit 200, a representative current compensation unit of the plurality of current feedback units has a first input 210, a second input 220, a third input 230, a first reference line 310 for receiving a first supply voltage, a second reference line 320 for receiving a second supply voltage, a ground terminal 300 for connecting to the ground of the LED driver, a comparator COMP-n, a sixth resistor $R_{g-n}$, a seventh resistor $R_{f-n}$, and an eighth resistor $R_{e-n}$. Each of the sixth resistor $R_{g-n}$, the seventh resistor $R_{f-n}$, and the eighth resistor $R_{e-n}$ has a first terminal and a second terminal, respectively.

The comparator COMP-n has a positive input 341, a negative input 343, an output 345, a first power supply input 347, and a second power supply input 349. The first power supply input 347 is coupled to the first reference line 310. The second power supply input 349 is coupled to the second reference line 320. The positive input 341 of the comparator COMP-n is coupled to the second input 220 and the negative input 343 of the comparator COMP-n is coupled to the third input 230. The first terminal of the sixth resistor $R_{g-n}$ is coupled to the first input 210. The second terminal of the sixth resistor $R_{g-n}$ is coupled to the ground terminal 300. The first terminal of the seventh resistor $R_{f-n}$ is coupled to the first input 210 and the first terminal of the sixth resistor $R_{g-n}$. The second terminal of the seventh resistor $R_{f-n}$ is coupled to the output 345 of the comparator COMP-n. The first terminal of the eighth resistor $R_{e-n}$ is coupled to the first reference line 310 and the first power supply input of the comparator COMP-n. The second terminal of the eighth resistor $R_{e-n}$ is coupled to the output 345 of the comparator COMP-n and the second terminal of the seventh resistor $R_{f-n}$.

Figure 3:
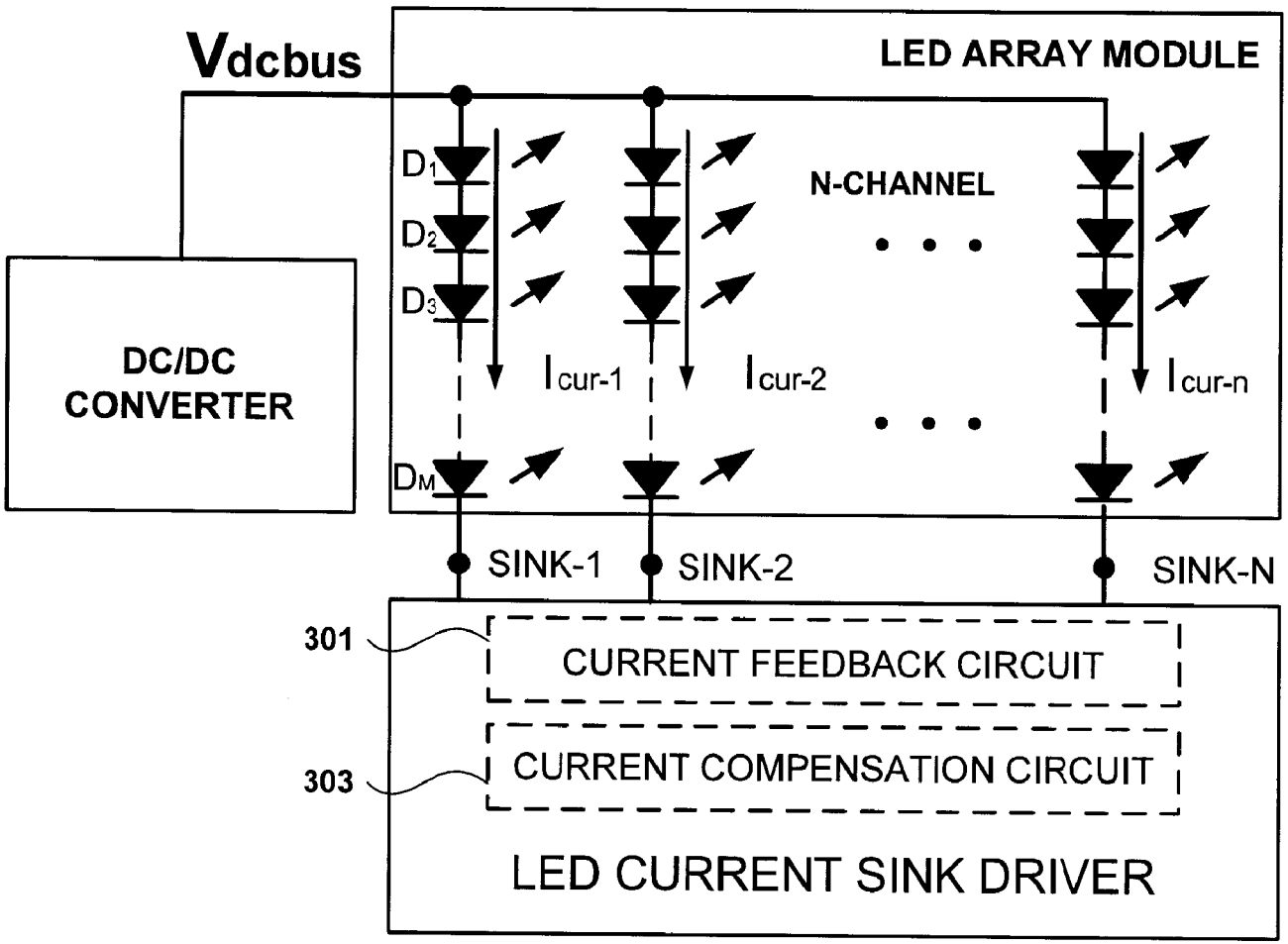
FIG. 3 shows a block diagram of an LED driver with current sink control and the detailed connection of an LED array module according to one embodiment of the present invention.

A complete circuit of the LED Driver with current sink control that has a DC/DC converter providing a DC voltage $V_{dcbus}$, an LED array modules having N columns of M serially connected LED $D_j$, j=1, 2, . . . M, (a total of N×M LEDs), and a current feedback circuit 301 and a current compensation circuit 303, is shown in FIG. 3. Each LED column has a first terminal and a second terminal. The first terminal of an LED column is electrically coupled to the anode of the first LED $D_1$. The cathode of each LED is electrically coupled to the anode of the anode of the next LED. The second terminal of the LED column is electrically coupled to the cathode of the M-th LED $D_M$. As shown in FIG. 3, the second terminal of n-th LED column is marked as SINK-n, where n=1, 2, . . . , N. Each of these LED columns is electrically coupled to input of a corresponding n-th current feedback unit of the current feedback circuit 301, respectively.

The LED array modules can be assembled with LED with various colors such as white color LED, red color LED, green color LED, blue color LED, or Red/Green/Blue combined color LED, and the like. For example, if a white color backlight is needed, N columns of M white color LED are used to construct the white LED backlight. If a tri-color (i.e. red, green and blue color) LED backlight is needed, N columns of M red color LED, N columns of M green color LED, and N columns of M blue color LED are used to form three LED columns with different color LED columns. Each of these three color LED columns is individually controlled and the corresponding red/green/blue color LED are combined to form a tri-color backlight for one pixel of the LCD screen. A tri-color LED backlight can also be made with Red/Green/Blue combined color LED. Here, each red, green and blue color LED is serially connected to the next same color LED to form three color LED columns such that each color LED column can be individually controlled. Each three color LED combination provides a three color backlight for each pixel of the LCD screen.

Figure 4:
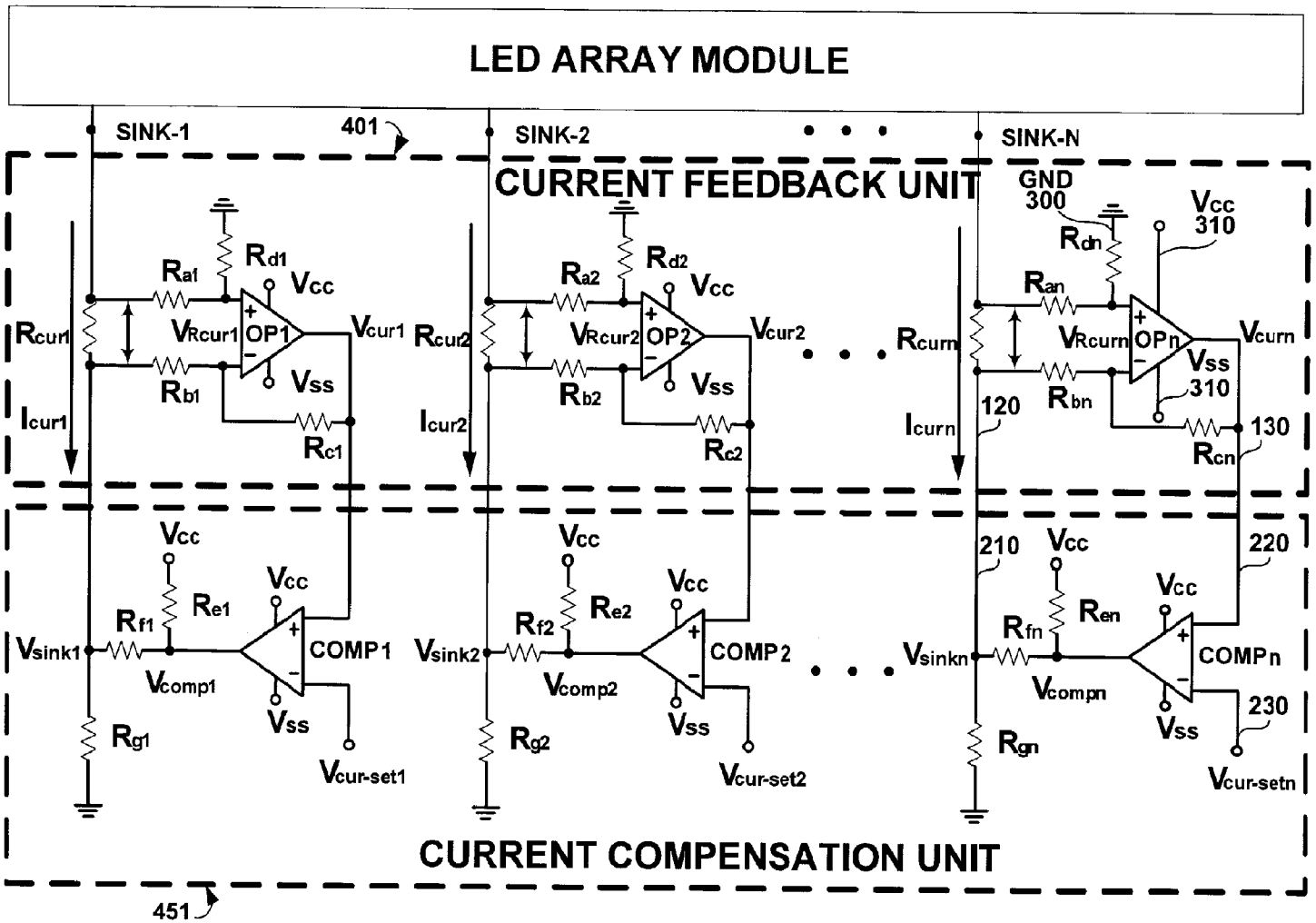
FIG. 4 shows a detailed circuit diagram of an LED driver with current sink control according to one embodiment of the present invention.
Figure 5:
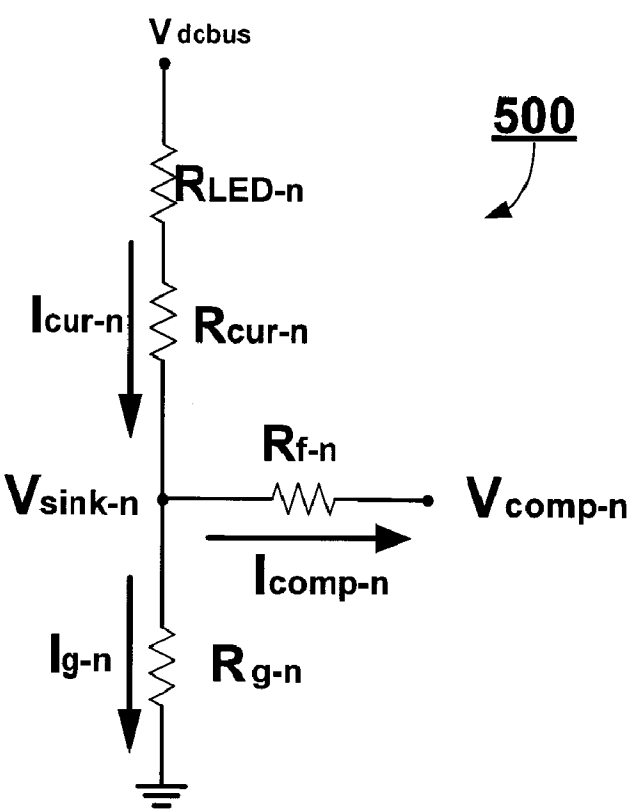
FIG. 5A illustrates an equivalent circuit showing current flow when over-current condition occurs.
FIG. 5B illustrates an equivalent circuit showing current flow when under-current condition occurs according to one embodiment of the present invention.
Figure 5:
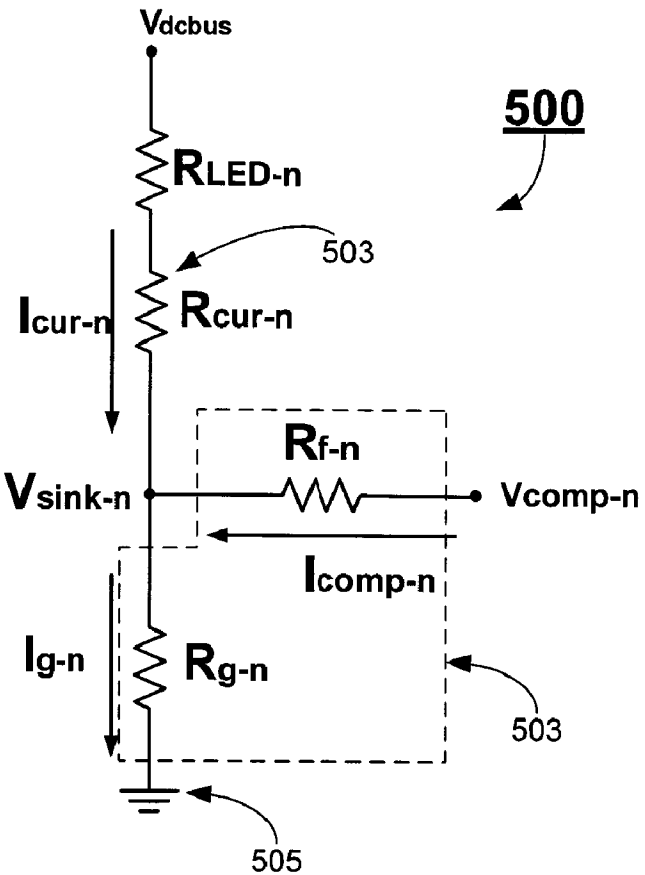

Referring now to FIG. 4, a more detailed circuit diagram of the LED driver with current sink control is partially shown according to one embodiment of the present invention. The first output 120 and the second output 130 of the n-th current feedback unit 401 are coupled to the first input 210 and second input 220 of the n-th current compensation unit 451, respectively. Each current feedback unit and each current compensation unit are provided with a first reference line 310, a second reference line 320, and a ground terminal 300. The third input 230 of the n-th current compensation unit is electrically coupled to a current setting input $V_{cur-set-n}$.

The circuit diagrams shown in FIG. 3 and FIG. 4 in principle may be reduced to one equivalent circuit 500 as shown in FIGS. 5A and 5B. The equivalent circuit 500 has an LED column, the n-th LED column, having M LEDs connected in serial, a current feedback unit 100, and a current compensation unit 200. The equivalent circuit 500 is identical in both FIGS. 5A and 5B, but under different operating conditions, as further discussed below. As shown in FIGS. 5A and 5B, the equivalent resistor $R_{LED-N}$ is the total combined resistance of the M LEDs in the n-th LED column. The resistor $R_{cur-n}$ is the first resistor of the n-th current feedback unit 100 shown in FIG. 1. The $R_{f-n}$ is the resistance of the seventh resistor of the n-th current compensation unit 200. $R_{g-n}$ is the sixth resistor of the n-th current compensation unit 200. The equivalent circuit has a DC voltage $V_{dcbus}$, and a ground terminal 300. The node connecting to $R_{cur-n}$, $R_{f-n}$ and $R_{g-n}$ is denoted as $V_{sink-n}$.

The current passing through n-th LED column is illustrated as $I_{cur-n}$. When the current $I_{cur-n}$ is greater than an ideal current level, it is referred to as over-current condition, which is shown in FIG. 5A and further discussed below. When the current $I_{cur-n}$ is less than the ideal current level, it is referred to as under-current condition, which is shown in FIG. 5B and further discussed below.

The current $I_{cur-n}$ is sampled through the first resistor $R_{cur-n}$ and in doing so, the current $I_{cur-n}$ generates a voltage $V_{Rcur-n}$ across the first resistor $R_{cur-n}$. The voltage output $V_{cur-n}$ of the operational amplifier OP-n is forwarded to the positive input of the comparator COMP-n (e.g. the second input 220 of the current compensation unit 200 shown in FIG. 2). This voltage $V_{cur-n}$ is compared to a predetermined voltage input as indicated as $V_{cur-set-n}$.

When an over-current condition occurs, as shown in FIG. 5A, the current passing through n-th LED column $I_{cur-n}$ is greater than the ideal current level. The current through the sixth resistor $R_{g-n}$ of the n-th current compensation unit 200 is $$I_{g-n}=I_{cur-n}+I_{comp-n} \tag{2}$$

When the voltage $V_{cur-n}$ is greater than the voltage $V_{cur-set-n}$, the output of the comparator COMP-n is high. The voltage output $V_{comp-n}$ is accordingly increased and the compensation current $I_{comp-n}$ is injected into the node $V_{sink-n}$ such that the compensation current $I_{comp}$ flows from the output $V_{comp-n}$ of the n-th comparator COMP-n to $V_{sink-n}$ as shown in FIG. 5A.

When an under-current condition occurs, as shown in FIG. 5B, the current through the n-th LED column $I_{cur-n}$ is less than the ideal current level. The current through the sixth resistor $R_{g-n}$ of the n-th current compensation unit 200, shown in FIG. 2 is $$I_{g-n}=I_{cur-n}-I_{comp-n} \quad (3)$$

When the voltage $V_{cur-n}$ is less than the voltage $V_{cur-set-n}$, the output of the comparator COMP-n is low. The voltage output $V_{comp-n}$ is accordingly decreased and the compensation current $I_{comp-n}$ is drawn from the node $V_{sink-n}$ such that the compensation current $I_{comp}$ flows from the node $V_{sink-n}$ to the output $V_{comp-n}$ of the n-th comparator COMP-n as shown in FIG. 5B.

The sixth and seventh resistor $R_{g-n}$ and $R_{f-n}$ can be chosen to achieve maximum adjustment range of the output voltage $V_{comp-n}$.

The predetermined voltage $V_{cur-set-n}$ can be set to receive a same voltage for all LED columns to achieve a uniform compensation level, which provides a consistent and uniform color temperature of the backlight. On the other hand, each individual LED column can be independently adjusted through other digital signals to achieve maximum color gamut.

From the equivalent circuit shown in FIGS. 5A and 5B, the n-th LED column is electrically coupled in serial with the first resistor $R_{cur-n}$. The current $I_{cur-n}$ flowing through these two components remains the same if the connection between these two components is swapped. Another embodiment of the present invention is shown in FIG. 6 with such a configuration.

In this embodiment, an LED driver with current sink control include a DC power source $V_{dcbus}$, N current feedback units, N LED columns having M LED connected in serial, and N current compensation units. Each LED column has a first terminal and a second terminal. The first terminal of an LED column is electrically coupled to the anode of the first LED. The cathode of each LED is electrically coupled to the anode of the anode of the next LED. The second terminal of the LED column is electrically coupled to the cathode of the M-th LED. As shown in FIG. 6, the second terminal of the n-th LED column is marked as SINK-n, where n=1, 2, . . . , N. The first output of the n-th current feedback unit is electrically coupled to the first terminal of the n-th LED column. Each of the second terminals of the N LED columns is electrically coupled to the input of a corresponding n-th current compensation unit. The second output of the n-th current feedback unit is electrically coupled to the second input of respective n-th current compensation unit.

Figure 6:
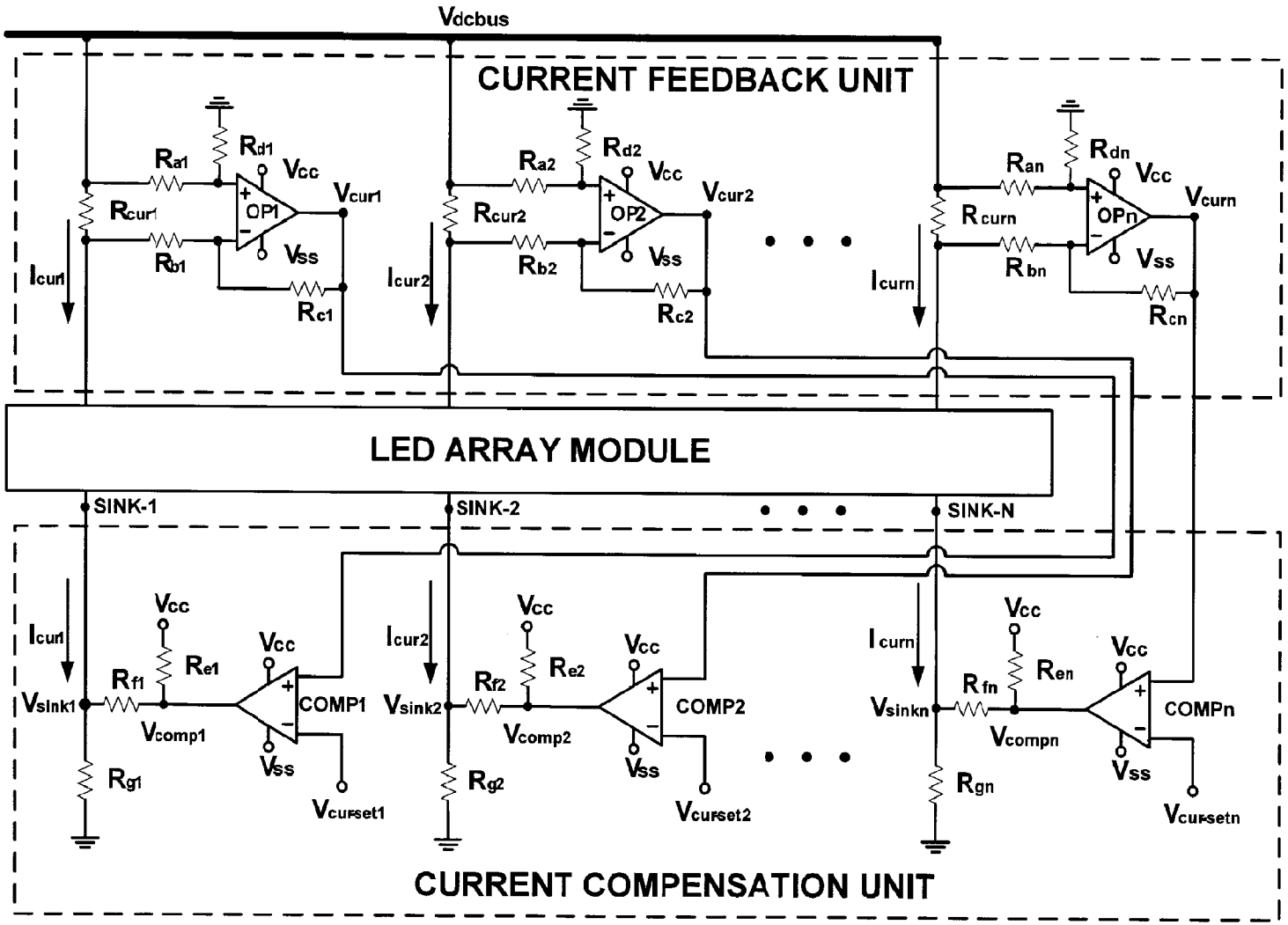
FIG. 6 shows a detailed circuit diagram of an LED driver with current sink control according to another embodiment of the present invention.
Figure 7:
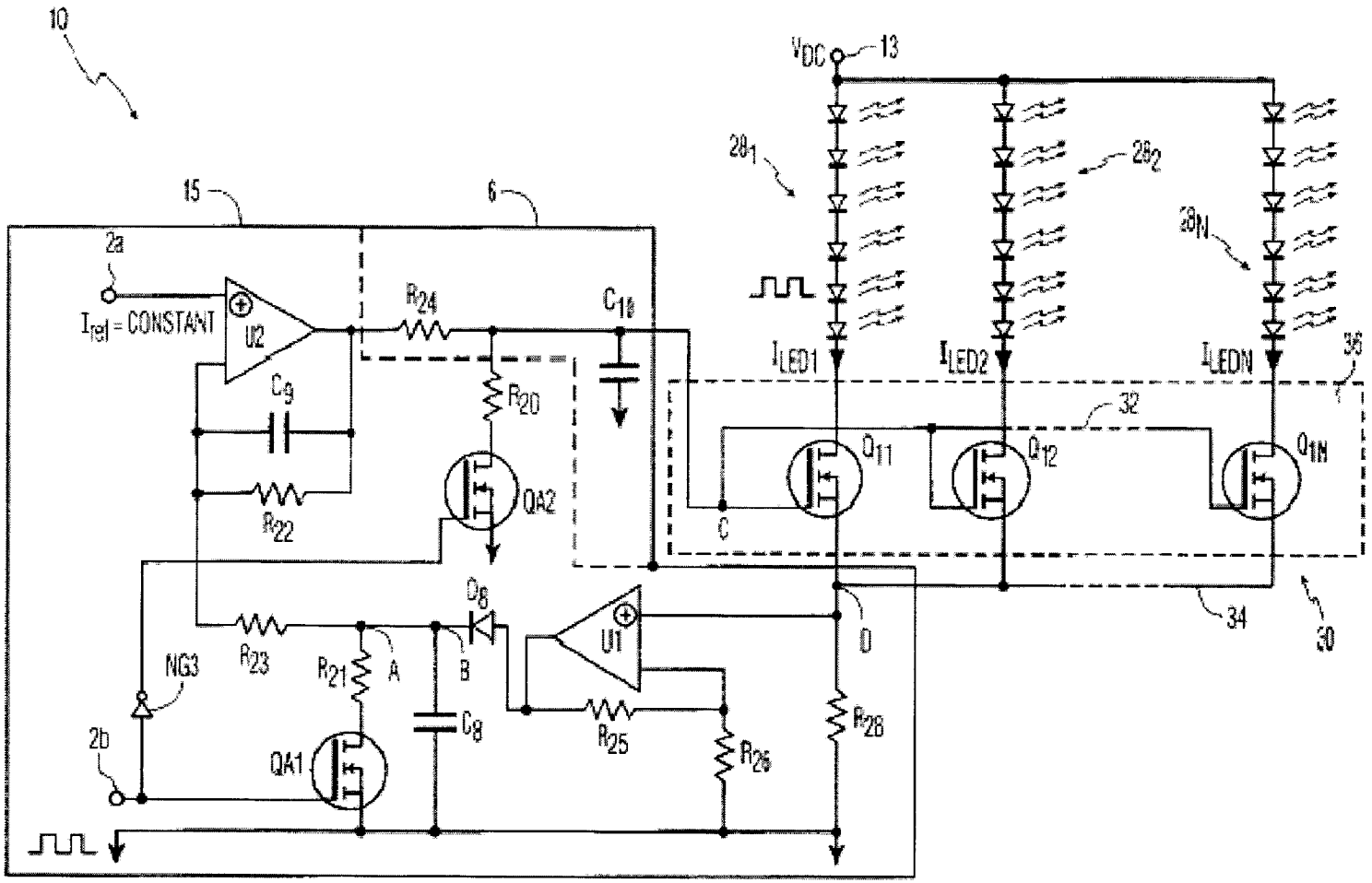
FIG. 7 (RELATED ART)
FIG. 7 shows a conventional circuit diagram of an integrated LED driving device.
Figure 8:
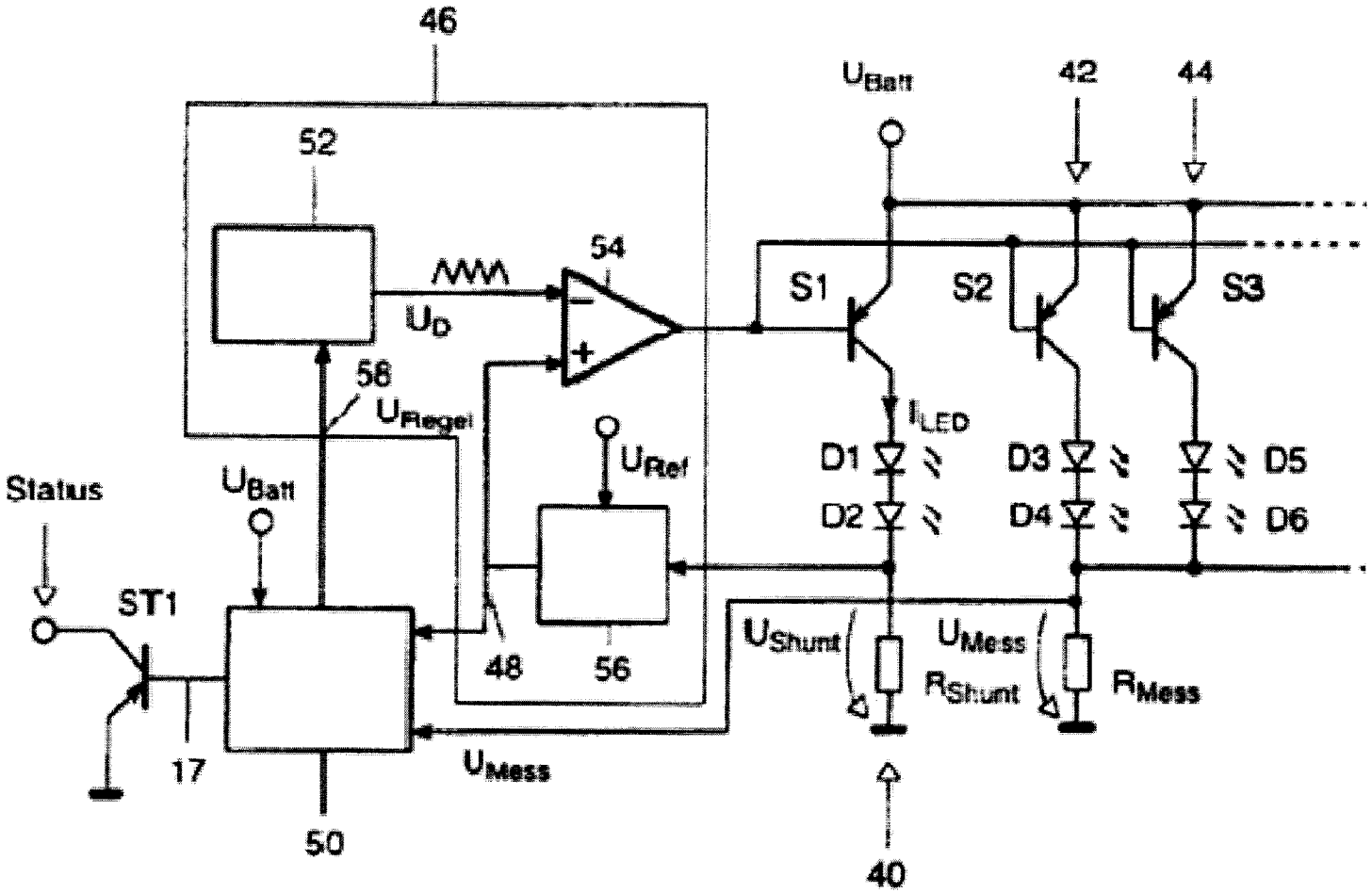
FIG. 8 (RELATED ART)
FIG. 8 shows another conventional circuit diagram of a drive circuit.

The circuit diagram according to the embodiment of the present invention shown in FIG. 6 can be reduced to similar equivalent circuits shown in FIGS. 5A and 5B for both over-current condition and under-current condition, respectively.

The LED driver with current sink control shown in FIGS. 1-6, according to various embodiments of the present invention as shown in FIGS. 1-7, has following advantages over currently available LED drivers:

- the LED driver with current sink control can be assembled as discrete component circuit as well as an integrated circuit;
- the number of LED columns of an LED driver with current sink control can be adjusted for different sizes of LED backlight for an LCD screen;
- the LED driver with current sink control reduces power consumption, and increases the overall efficiency of an LED backlight system using the LED driver;
- the LED driver with current sink control can be used with large LED array modules and provides greater color gamut;
- the LED driver with current sink control provides large current compensation adjustment ranges;
- the LED driver with current sink control provides individually controllable current compensation for each individual LED column, where each Red/Blue/Green LED column is able to achieve overall color temperature compensation and control;
- the LED driver with current sink control can be used in combination with proper Application Specific Integrated Circuit (ASIC) image control signal is to control the brightness of the backlight LED array module to further enhance the quality of the image displayed on the LCD screen; and
- the LED driver with current sink control uses the current feedback and current compensation to precisely compensate and control the current through each LED column, to adjust the brightness of the image and compensate the color temperature of the image such that the resulted images have greater dynamic ranges of the brightness, contrast, and natural color temperature.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A current feedback circuit for use in a light emitting diode (LED) driver with current sink control comprising a plurality of current feedback units, wherein each of the plurality of current feedback units comprises:

a. an input;

b. a first output;

c. a second output;

d. a first reference line for receiving a first supply voltage;

e. a second reference line for receiving a second supply voltage;

f. a ground terminal for connecting to the ground of the LED driver;

g. an operational amplifier (op-amp) having a positive input, a negative input, an output, a first power supply input, and a second power supply input, wherein the first power supply input is electrically coupled to the first reference line, the second power supply input is electrically coupled to the second reference line, and the output is electrically coupled to the second output;

h. a first resistor having a first terminal and a second terminal, wherein the first terminal is electrically coupled to the input, and the second terminal is electrically coupled to the first output;

i. a second resistor having a first terminal and a second terminal, wherein the first terminal is electrically coupled to the first terminal of the first resistor and the second terminal is electrically coupled to the positive input of the op-amp;

j. a third resistor having a first terminal and a second terminal, wherein the first terminal is electrically coupled to the second terminal of the first resistor and the second terminal is electrically coupled to the negative input of the op-amp;

k. a fourth resistor having a first terminal and a second terminal, wherein the first terminal is electrically coupled to the negative input of the op-amp and the second terminal is electrically coupled to the output of the op-amp and the second output; and l. a fifth resistor having a first terminal and a second terminal, wherein the first terminal is electrically coupled to the positive input of the op-amp, and the second terminal is electrically coupled to the ground terminal.

2. The current feedback circuit of claim 1, wherein each current feedback unit is adapted for coupling with a column of LED that has a plurality of LEDs connected in serial, $\{D_j\}$, j=1, 2, . . . , M, M being a positive integer, wherein each of the plurality of LEDs has an anode and a cathode, and the LED column has a first terminal and a second terminal, wherein the first terminal of the LED column is electrically coupled to the anode of the first LED, the anode of the j-th LED is electrically coupled to the cathode of the (j−1)-th LED, the cathode of the j-th LED is electrically coupled to the anode of the (j+1)-th LED, and the cathode of the M-th LED is electrically coupled to the second terminal of the LED column, respectively.

3. A current compensation circuit for use in an LED driver with current sink control comprising a plurality of current compensation units, wherein each of the plurality of current compensation units comprises:

a. a first input;

b. a second input;

c. a third input;

d. a first reference line for receiving a first supply voltage;

e. a second reference line for receiving a second supply voltage;

f. a ground terminal for connecting to the ground of the LED driver;

g. a comparator having a positive input, a negative input, an output, a first power supply input, and a second power supply input, wherein the first power supply input is electrically coupled to the first reference line, the second power supply input is electrically coupled to the second reference line, the positive input is electrically coupled to the second input, and the negative input is electrically coupled to the third input;

h. a first resistor having a first terminal and a second terminal, wherein the first terminal is electrically coupled to the first input, and the second terminal is electrically coupled to the ground terminal;

i. a second resistor having a first terminal and a second terminal, wherein the first terminal is electrically coupled to the first input and the first terminal of the first resistor, and the second terminal is electrically coupled to the output of the comparator; and j. an third resistor having a first terminal and a second terminal, wherein the first terminal is electrically coupled to the first reference line and the first power supply input of the comparator, the second terminal is electrically coupled to the output of the comparator and the second terminal of the second resistor.

4. The current compensation circuit of claim 3, wherein each current compensation unit is adapted for coupling with a column of LED that has a plurality of LEDs connected in serial, $\{D_j\}$, j=1, 2, . . . , M, M being a positive integer, wherein each of the plurality of LEDs has an anode and a cathode, and the LED column has a first terminal and a second terminal, wherein the first terminal of the LED column is electrically coupled to the anode of the first LED, the anode of the j-th LED is electrically coupled to the cathode of the (j−1)-th LED, the cathode of the j-th LED is electrically coupled to the anode of the (j+1)-th LED, and the cathode of the M-th LED is electrically coupled to the second terminal of the LED column, respectively.

5. A backlight system for use in an LCD display with a driver providing current sink control, comprising:

a. an LED array module comprising N columns of LEDs, {Ci}, i=1, 2, . . . , N, N being a positive integer, wherein each LED column has a first terminal, a second terminal and a plurality of LEDs connected in serial, {Rj}, j=1, 2, . . . , M, M being a positive integer, wherein each of the plurality of LEDs has an anode and a cathode, the anode of the first LED of an LED column is electrically coupled to the first terminal of the LED column, the cathode of the j-th LED is electrically coupled to the anode of the (j+1)-th LED, the anode of the j-th LED is electrically coupled to the cathode of the (j−1)-th LED, the cathode of the M-th LED of the LED column is electrically coupled to the second terminal of the LED column, and wherein the N LED columns are electrically coupled in parallel, each of the first terminal of the N LED columns is electrically coupled to a DC power supply;

b. a current feedback circuit having N current feedback units {CFn}, n=1, 2, . . . , N, each of the N current feedback units having an input, a first output and a second output, wherein the n-th current feedback unit CFn is electrically coupled to the n-th LED column Cn, and the first input of the n-th current feedback unit is electrically coupled to the second terminal of the n-th LED column Cn; and c. a current compensation circuit having N current compensation units {CCn}, n=1, 2, . . . , N, each of the N current compensation units having a first input, a second input, and a third input, wherein the n-th current compensation unit CCn is electrically coupled to the n-th current feedback unit CFn, the first output of the n-th current feedback unit CFn is electrically coupled to the first input of the n-th current compensation unit CCn, and the second output of the n-th current feedback unit CFn is electrically coupled to the second input of the n-th current compensation unit CCn, wherein, in operation, a current passes through the n-th LED column, the first input and first output of the n-th current feedback unit CFn, and the first input of the n-th current compensation unit CCn, and an output voltage is generated at the second output of the n-th current feedback unit CFn, and wherein the output voltage is provided to the second input of the n-th current compensation unit for comparison with a predetermined DC voltage electrically coupled to the third input of the current compensation unit CCn, and the n-th current compensation unit CCn compensates for the current based on the results of the comparison.

6. The backlight system of claim 5, wherein each current feedback unit further comprises:

a. a first reference line for receiving a first supply voltage;

b. a second reference line for receiving a second supply voltage;

c. a ground terminal for connecting to the ground of the LED driver;

d. an operational amplifier (op-amp) having a positive input, a negative input, an output, a first power supply input, and a second power supply input, wherein the first power supply input is electrically coupled to the first reference line, the second power supply input is electrically coupled to the second reference line, and the output is electrically coupled to the second output, respectively;

e. a first resistor having a first terminal and a second terminal, wherein the first terminal is electrically coupled to the first input, and the second terminal is electrically coupled to the first output;

f. a second resistor having a first terminal and a second terminal, wherein the first terminal is electrically coupled to the first terminal of the first resistor and the second terminal is electrically coupled to the positive input of the op-amp;

g. a third resistor having a first terminal and a second terminal, wherein the first terminal is electrically coupled to the second terminal of the first resistor and the second terminal is electrically coupled to the negative input of the op-amp;

h. a fourth resistor having a first terminal and a second terminal, wherein the first terminal is electrically coupled to the negative input of the op-amp and the second terminal is electrically coupled to the output of the op-amp and the second output; and i. a fifth resistor having a first terminal and a second terminal, wherein the first terminal is electrically coupled to the positive input of the op-amp, and the second terminal is electrically coupled to the ground terminal.

7. The backlight system of claim 6, wherein each current compensation unit further comprises:

a. a third input;

b. a first reference line for receiving a first supply voltage;

c. a second reference line for receiving a second supply voltage;

d. a ground terminal for connecting to the ground of the LED driver;

e. a comparator having a positive input, a negative input, an output, a first power supply input, and a second power supply input, wherein the first power supply input is electrically coupled to the first reference line, the second power supply input is electrically coupled to the second reference line, the positive input is electrically coupled to the second input, and the negative input is electrically coupled to the third input;

f. a sixth resistor having a first terminal and a second terminal, wherein the first terminal is electrically coupled to the first input, and the second terminal is electrically coupled to the ground terminal;

g. a seventh resistor having a first terminal and a second terminal, wherein the first terminal is electrically coupled to the first input and the first terminal of the sixth resistor, and the second terminal is electrically coupled to the output of the comparator; and h. an eighth resistor having a first terminal and a second terminal, wherein the first terminal is electrically coupled to the first reference line and the first power supply input of the comparator, the second terminal is electrically coupled to the output of the comparator and the second terminal of the seventh resistor.

8. The backlight system of claim 7, wherein when the output voltage of the n-th current feedback unit CFn is greater than the predetermined DC voltage electrically coupled to the third input of the n-th current compensation unit CCn, the output of the comparator of the n-th current compensation unit CCn provides a positive voltage to cause a compensation current to flow from the second terminal to the first terminal of the seventh resistor.

9. The backlight system of claim 7, wherein when the output voltage of the n-th current feedback unit CFn is less than the predetermined DC voltage electrically coupled to the third input of the n-th current compensation unit CCn, the output of the comparator of the n-th current compensation unit CCn provides a negative voltage to cause a compensation current to flow from the first terminal to the second terminal of the seventh resistor.

10. The backlight system of claim 5, wherein the LED array module provides backlights with a plurality of colors for the LCD panel.

11. The backlight system of claim 5, wherein a plurality smaller sized LED array modules are combined to provide backlight for a larger size LCD panels.

12. The backlight system of claim 5, wherein the current of each of the N LED columns is individually controllable and precisely compensatable.

13. The backlight system of claim 5, wherein a column of M LEDs in a first color L1*i*, a column of M LEDs in a second color L2*i*, and a column of M LEDs in a third color L3*i*, {i}i=1, 2, . . . , M, are combined to provide multi-color backlight for a LCD panel, and wherein the i-th L1*i*, the i-th L2*i* and the i-th L3*i* are combined to provide backlight for a corresponding portion of the LCD panel.

14. An LED driver with current sink control for an LED array module, wherein the LED array module comprises N columns of LEDs, $\{C_i\}$, i=1, 2, . . . , N, N being a positive integer, wherein each LED column having a first terminal, a second terminal and a plurality of light emitting diodes connected in serial, $\{R_j\}$, j=1, 2, . . . , M, M being a positive integer, wherein each of the plurality of LEDs has an anode and a cathode, the anode of the first LED $R_1$ of an LED column is electrically coupled to the first terminal of the LED column, the cathode of the j-th LED is electrically coupled to the anode of the (j+1)-th LED, the anode of the j-th LED is electrically coupled to the cathode of the (j−1)-th LED, the cathode of the last LED $R_M$ of the LED column is electrically coupled to the second terminal of the LED column, and wherein the N LED columns are electrically coupled in parallel, each first terminal of each of the N LED columns is electrically coupled to a DC power supply, comprising:

a. a current feedback circuit having N current feedback units {CFn}, n=1, 2, . . . , N, each of the N current feedback units having an input, a first output and a second output, wherein the n-th current feedback unit CFn is electrically coupled to the n-th LED column Cn, and the first input of the n-th current feedback unit is electrically coupled to the second terminal of the n-th LED column Cn; and b. a current compensation circuit having N current compensation units {CCn}, n=1, 2, . . . , N, each of the N current compensation units having a first input, a second input and a third input, wherein the n-th current compensation unit CCn is electrically coupled to the n-th current feedback unit CFn, the first output of the n-th current feedback unit CFn is electrically coupled to the first input of the n-th current compensation unit CCn, and the second output of the n-th current feedback unit CFn is electrically coupled to the second input of the n-th current compensation unit CCn, respectively, wherein, in operation, a current passes through the n-th LED column, the first input and first output of the n-th current feedback unit CFn, and the first input of the n-th current compensation unit CCn, and an output voltage is generated at the second output of the n-th current feedback unit CFn, and wherein the output voltage is provided to the second input of the n-th current compensation unit for comparison with a predetermined DC voltage electrically coupled to the third input of the current compensation unit CCn, and the n-th current compensation unit CCn compensates the current based on the results of the comparison.

15. The LED driver of claim 14, wherein each current feedback unit further comprises:

a. a first reference line for receiving a first supply voltage;

b. a second reference line for receiving a second supply voltage;

c. a ground terminal for connecting to the ground of the LED driver;

d. an operational amplifier (op-amp) having a positive input, a negative input, an output, a first power supply input, and a second power supply input, wherein the first power supply input is electrically coupled to the first reference line, the second power supply input is electrically coupled to the second reference line, and the output is electrically coupled to the second output;

e. a first resistor having a first terminal and a second terminal, wherein the first terminal is electrically coupled to the first input, and the second terminal is electrically coupled to the first output;

f. a second resistor having a first terminal and a second terminal, wherein the first terminal is electrically coupled to the first terminal of the first resistor and the second terminal is electrically coupled to the positive input of the op-amp;

g. a third resistor having a first terminal and a second terminal, wherein the first terminal is electrically coupled to the second terminal of the first resistor and the second terminal is electrically coupled to the negative input of the op-amp;

h. a fourth resistor having a first terminal and a second terminal, wherein the first terminal is electrically coupled to the negative input of the op-amp and the second terminal is electrically coupled to the output of the op-amp and the second output; and i. a fifth resistor having a first terminal and a second terminal, wherein the first terminal is electrically coupled to the positive input of the op-amp, and the second terminal is electrically coupled to the ground terminal.

16. The LED driver of claim 15, wherein each current compensation unit further comprises:

a. a third input;

b. a first reference line for receiving a first supply voltage;

c. a second reference line for receiving a second supply voltage;

d. a ground terminal for connecting to the ground of the LED driver;

e. a comparator having a positive input, a negative input, an output, a first power supply input, and a second power supply input, wherein the first power supply input is electrically coupled to the first reference line, the second power supply input is electrically coupled to the second reference line, the positive input is electrically coupled to the second input, and the negative input is electrically coupled to the third input;

f. a sixth resistor having a first terminal and a second terminal, wherein the first terminal is electrically coupled to the first input, and the second terminal is electrically coupled to the ground terminal;

g. a seventh resistor having a first terminal and a second terminal, wherein the first terminal is electrically coupled to the first input and the first terminal of the sixth resistor, and the second terminal is electrically coupled to the output of the comparator; and h. an eighth resistor having a first terminal and a second terminal, wherein the first terminal is electrically coupled to the first reference line and the first power supply input of the comparator, and the second terminal is electrically coupled to the output of the comparator and the second terminal of the seventh resistor.

17. The LED driver of claim 16, wherein when the output voltage of the n-th current feedback unit CFn is greater than the predetermined DC voltage electrically coupled to the third input of the n-th current compensation unit CCn, the output of the n-th comparator of the n-th current compensation unit CCn provides a positive voltage to cause a compensation current to flow from the second terminal to the first terminal of the seventh resistor.

18. The LED driver of claim 16, wherein when the output voltage of the n-th current feedback unit CFn is less than the predetermined DC voltage electrically coupled to the third input of the n-th current compensation unit CCn, the output of the n-th comparator of the n-th current compensation unit CCn provides a negative voltage and cause a compensation current to flow from the first terminal to the second terminal of the seventh resistor.

19. The LED driver of claim 16, wherein the current of each of the N LED columns is individually controllable and precisely compensatable.

20. A backlight system for use in an LCD display with a driver providing current sink control, comprising:

a. an LED array module, wherein the LED array module comprises N columns of LEDs, $\{C_i\}$, i=1, 2, . . . , N, N being a positive integer, wherein each LED column has a first terminal, a second terminal and a plurality of LEDs connected in serial, $\{R_j\}$, j=1, 2, . . . , M, M being a positive integer, wherein each of the plurality of LEDs has an anode and a cathode, the anode of the first LED $R_1$ of the LED column is electrically coupled to the first terminal of the LED column, the cathode of the j-th LED is electrically coupled to the anode of the (j+1)-th LED, the anode of the j-th LED is electrically coupled to the cathode of the (j−1)-th LED, the cathode of the last LED $R_M$ of the LED column is electrically coupled to the second terminal of the LED column, and wherein the N LED columns are electrically coupled in parallel;

b. a current feedback circuit having N current feedback units {CFn}, n=1, 2, . . . , N, each of the N current feedback units having an input, a first output and a second output, wherein the input of the n-th current feedback unit CFn is electrically coupled to the n-th LED column Cn and a DC power supply, and wherein the first input of the n-th current feedback unit is electrically coupled to the DC power supply, and the first output of the n-th current feedback unit is electrically coupled to the first terminal of the n-th LED column Cn; and c. a current compensation circuit having N current compensation units {CCn}, n=1, 2, . . . , N, each of the N current compensation units having a first input, a second input and a third input, wherein the n-th current compensation unit CCn is electrically coupled to the n-th current feedback unit CFn and the n-th LED column, the second terminal of the n-th LED column is electrically coupled to the first input of the n-th current compensation unit CCn, and the second input of the n-th current compensation unit CCn is electrically coupled to the second output of the n-th current feedback unit CFn, wherein, in operation, a current passes through the first input and first output of the n-th current feedback unit CFn, the n-th LED column, and the first input of the n-th current compensation unit CCn, and an output voltage is generated at the second output of the n-th current feedback unit CFn, wherein the output voltage is provided to the second input of the n-th current compensation unit for comparison with a predetermined DC voltage electrically coupled to the third input of the current compensation unit CCn, and the n-th current compensation unit CCn compensates the current based on the results of the comparison.

21. The backlight system of claim 19, wherein each current feedback unit further comprises:

a. a first reference line for receiving a first supply voltage;

b. a second reference line for receiving a second supply voltage;

c. a ground terminal for connecting to the ground of the LED driver;

d. an operational amplifier (op-amp) having a positive input, a negative input, an output, a first power supply input, and a second power supply input, wherein the first power supply input is electrically coupled to the first reference line, the second power supply input is electrically coupled to the second reference line, and the output is electrically coupled to the second output;

e. a first resistor having a first terminal and a second terminal, wherein the first terminal is electrically coupled to the first input, and the second terminal is electrically coupled to the first output;

f. a second resistor having a first terminal and a second terminal, wherein the first terminal is electrically coupled to the first terminal of the first resistor and the second terminal is electrically coupled to the positive input of the op-amp;

g. a third resistor having a first terminal and a second terminal, wherein the first terminal is electrically coupled to the second terminal of the first resistor and the second terminal is electrically coupled to the negative input of the op-amp;

h. a fourth resistor having a first terminal and a second terminal, wherein the first terminal is electrically coupled to the negative input of the op-amp and the second terminal is electrically coupled to the output of the op-amp and the second output; and i. a fifth resistor having a first terminal and a second terminal, wherein the first terminal is electrically coupled to the positive input of the op-amp, and the second terminal is electrically coupled to the ground terminal.

22. The backlight system of claim 20, wherein each current compensation unit further comprises:

a. a third input;

b. a first reference line for receiving a first supply voltage;

c. a second reference line for receiving a second supply voltage;

d. a ground terminal for connecting to the ground of the LED driver;

e. a comparator having a positive input, a negative input, an output, a first power supply input, and a second power supply input, wherein the first power supply input is electrically coupled to the first reference line, the second power supply input is electrically coupled to the second reference line, the positive input is electrically coupled to the second input, and the negative input is electrically coupled to the third input;

f. a sixth resistor having a first terminal and a second terminal, wherein the first terminal is electrically coupled to the first input, and the second terminal is electrically coupled to the ground terminal;

g. a seventh resistor having a first terminal and a second terminal, wherein the first terminal is electrically coupled to the first input and the first terminal of the sixth resistor, and the second terminal is electrically coupled to the output of the comparator; and h. an eighth resistor having a first terminal and a second terminal, wherein the first terminal is electrically coupled to the first reference line and the first power supply input of the comparator, the second terminal is electrically coupled to the output of the comparator and the second terminal of the seventh resistor.

23. The backlight system of claim 19, wherein when the output voltage of the n-th current feedback unit CFn is greater than the predetermined DC voltage electrically coupled to the third input of the n-th current compensation unit CCn, the output of the n-th comparator of the n-th current compensation unit CCn provides a positive voltage to cause a compensation current to flow from the second terminal to the first terminal of the seventh resistor.

24. The backlight system of claim 19, wherein when the output voltage of the n-th current feedback unit CFn is less than the predetermined DC voltage electrically coupled to the third input of the n-th current compensation unit CCn, the output of the n-th comparator of the n-th current compensation unit CCn provides a negative voltage to cause a compensation current to flow from the first terminal to the second terminal of the seventh resistor.

25. The backlight system of claim 19, wherein the current of each of the N LED columns is individually controllable and precisely compensatable.

* * * * *